United States Patent [19]

Cherry et al.

[11] 4,216,360

[45] Aug. 5, 1980

[54] LOW VOLTAGE VACUUM SWITCH WITH INTERNAL ARCING SHIELD

[75] Inventors: Sidney J. Cherry, Elmira; Robert M. Hruda, Horseheads; Paul O. Wayland, Montour Falls, all of N.Y.

[73] Assignee: Westinghouse Electric Corp., Pittsburgh, Pa.

[21] Appl. No.: 928,640

[22] Filed: Jul. 27, 1978

[51] Int. Cl.[3] ..... H01H 33/66

[52] U.S. Cl. ..... 200/144 B; 200/83 B

[58] Field of Search ..... 200/83 B, 83 C, 83 D, 200/83 N, 144 B

[56] References Cited

U.S. PATENT DOCUMENTS

| | | | |
|---|---|---|---|
| 3,087,034 | 4/1963 | Beers et al. | 200/144 B |
| 3,590,185 | 6/1971 | Pflanz | 200/144 B |
| 3,597,558 | 8/1971 | Gotsch | 200/144 B |
| 3,626,123 | 12/1971 | Pflanz et al. | 200/144 B |
| 3,668,350 | 6/1972 | Takeuchi et al. | 200/144 B |
| 3,941,960 | 3/1976 | Umeya et al. | 200/144 B |
| 3,950,628 | 4/1976 | Hruda | 200/144 B X |
| 4,075,448 | 2/1978 | Seedorf et al. | 200/144 B X |
| 4,088,859 | 5/1978 | Hruda | 200/144 B |

FOREIGN PATENT DOCUMENTS

| | | | |
|---|---|---|---|
| 563140 | 11/1932 | Fed. Rep. of Germany | 200/144 B |
| 2260587 | 6/1974 | Fed. Rep. of Germany . | |
| 1093231 | 11/1967 | United Kingdom | 200/144 B |

*Primary Examiner*—James R. Scott

*Attorney, Agent, or Firm*—W. G. Sutcliff

[57] ABSTRACT

An improved low voltage, high current D.C. vacuum switch is provided by disposing an arcing shield annularly about the arcing contact area within the vacuum switch. The arcing shield prevents disposition of conductive contact material on the insulator body wall of the switch and also shields the flexible corrugated annular member which permits switch contact movement to open and close the switch. The arcing shield may be floating electrically, or connected to the electrically positive side of the switch contacts.

12 Claims, 4 Drawing Figures

LOW VOLTAGE VACUUM SWITCH WITH INTERNAL ARCING SHIELD

BACKGROUND OF THE INVENTION

The present invention relates to low voltage vacuum switches which are typically used in electrolytic chemical processing plants. The switches are used as shorting switches which carry thousands of amperes of current at low D.C. voltage levels. The switches are actuated for shunting a chemical cell such as described in U.S. Pat. No. 4,075,448.

A low voltage vacuum switch is described in abandoned application Ser. No. 650,322, filed Jan. 19, 1976 entitled "Low Voltage Vacuum Shorting Switch". The switch described in the copending application utilizes flexible annular corrugated annular diaphragm end walls, which are sealed to an annular insulating ring-like body portion at their outer perimeters, and to cylindrical conductive contacts at their interior perimeters to complete the evacuated switch. The flexible annular corrugated diaphragm members provide the requisite flexibility so that the contacts can be moved into and out of contact with axial force. These flexible end members are relatively thin metal members with several annular corrugations between the interior perimeter and the exterior perimeter. When the contacts are separated, a D.C. arc is struck between the separated contacts, and several thousand amperes of current will flow until interruption is effected when the arc voltage across the electrodes is greater than the applied voltage from the circuit to which it is connected. It has been found that during the dissipation of the inductive energy of the circuit during arcing the magnitude of the arc may be such that the arc moves off the contact base and is directed onto the thin annular diaphragm wall with a possibility of burning a hole in the diaphragm. This is particularly a problem with respect to the flexible annular diaphragm at the electrically positive connected contact of the switch.

It has also been observed that during the arcing process contact material which is evaporated can be thrown out from between the contacts and deposited along the annular insulator body. This evaporated contact material will then be deposited as a film across the insulator body and can give rise to high leakage currents between the contacts along this thin deposited film. Such a leakage current creates several problems associated with the installation or removal of a switch from an operating cell and subsequent testing. A vacuum switch which has a heavy film deposit of conductor across the insulator body cannot be bolted in place or removed from an operating cell without causing sparking when the terminals are connected or disconnected from the circuit. Such sparking creates a safety hazard within the typical operating environment of the electrolytic cell. The standard technique for determining the integrity and operability of the vacuum switch is to subject the switch to a high voltage across the open contacts to check whether the switch remains evacuated and can withstand the voltage across the contacts. Such a high voltage test cannot be performed if a high leakage current film exists across the insulator body.

The use of electrically floating conductive shields within A.C. vacuum interrupters is well known in the art. Such arcing shields have been used to protect the insulating walls of such evacuated bottles from being coated and/or destroyed by hot evaporated product from the contact areas.

SUMMARY OF THE INVENTION

A low voltage, high power vacuum switch is detailed in which a generally annular, conductive, heat dissipation shield is disposed within the vacuum switch about the contact members and between the contact members and the annular insulating body of the switch. This annular conductive shield can thereby prevent deposition of contact material as a thin film upon the insulator body. In another embodiment of the present invention, the generally annular conductive shield extends from one of the contact members and also shields the flexible annular diaphragm associated with that end of the switch from the evaporated contact materials.

The vacuum switch of the present invention is designed for electrolytic cell shunting operation. The vacuum switch is connectable in parallel across the electrodes of an electrolytic cell, with the switch contacts being open during cell operation. The switch contacts are closed to shunt the cell to permit maintenance of the cell. The vacuum switch is operable in the closed contact position at up to about 6000 D.C. amperes continuous current. The switch will interrupt this high amperage continuous current when the contacts are separated to the open switch position at a voltage of up to about 10 volts D.C. The continuous D.C. current operating rating of the switch and the contact area are such that the switch rating is about 1600 amperes per contact area square inch, and wherein the switch will not exceed an operating temperature of greater than about 105° C.

DESCRIPTION OF THE PREFERRED EMBODIMENT

Figure 1:
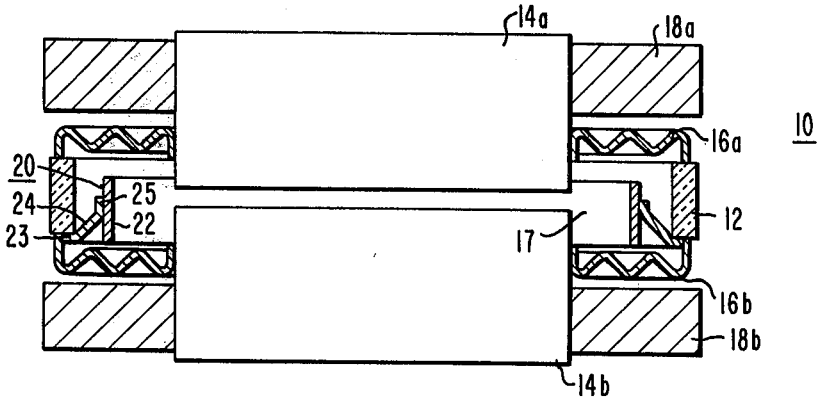
FIG. 1 is an elevational view in section of an embodiment of the low voltage vacuum switch of the present invention.

The low voltage vacuum switch 10 seen in FIG. 1 comprises annular insulating ring body portion 12, a pair of cylindrical conductive contact members **14*a*, 14*b*, and a pair of flexible annular corrugated diaphragm members 16*a*, 16*b* which are sealed to and extend between the insulator body 12 and the respective cylindrical contacts 14*a*, 14*b*. An evacuated switch chamber 17 is defined by this insulator body 12, the cylindrical contacts 14*a* and 14*b* and the annular diaphragm 16*a* and 16*b*, and is at least partially evacuated, and typically to a pressure of less than about $10^{-6}$ torr. The cylindrical contacts are shown in the open circuit position in FIG. 1. The contacts are normally in a closed contact abutting position due to the pressure of the atmosphere upon the evacuated switch. In order to bring the contacts to the open circuit position as seen in FIG. 1, an opposing axial force must be imposed upon the opposed contacts. The annular flexible diaphragm has sufficient flexibility to permit movement of the contact cylinders into and out of contact. The annular corrugations of the diaphragm are such as to provide sufficient rigidity to ensure that the contacts remain in a relatively parallel contact face relationship with each other to ensure that a high proportion of the total contact area is utilized for both current carrying capacity in the closed switch position and also for arc dissipation effect in the open contact position. Planar mounting means 18***a* and 18*b* are electrically connected to the cylindrical contacts outside the vacuum switch to facilitate connection of such contacts to the desired electrical circuit apparatus. Such planar mounting means 18*a* and 18*b* are apertured to permit the cylindrical contacts to fit therein and to be brazed or welded thereto.

An annular arcing shield 20 is disposed within the vacuum chamber and in the embodiment of FIG. 1 comprises a tubular portion 22 and an annular supporting member 24 which is supported from the insulating body member 12. The annular supporting member 24 has an angled cross-section to permit one extending end 23 to be brazed to a metallized layer on the end of the insulating body wall, and the other angled extending end 25 to be brazed to the exterior of the tubular portion 22. The tubular portion 22 of arcing shield 20 is disposed spaced from the insulator body wall between the insulator body and the extending end of the cylindrical contacts where the arcing takes place. The annular arcing shield 20 prevents line of sight deposition of evolved contact material upon the insulator body wall. In this way, no conductive film can be deposited upon the insulator body which would interfere with high voltage testing above the switch. The arcing shield is preferably formed of a conductive metal such as copper for ease of mounting, and also has good heat dissipation characteristics. The tubular portion 22 of the arcing shield is formed of copper, while the supporting member 24 is formed of "Kovar", a trademarked material of Westinghouse Electric Corporation. The supporting member 24 could also be a plurality of spaced apart support member instead of being a unitary member.

Figure 2:
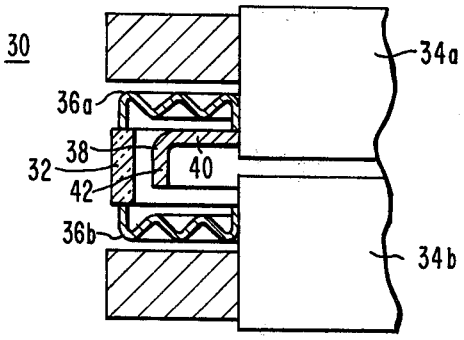
FIG. 2 is also a partial elevational view in section of a different embodiment low voltage vacuum switch of the present invention.

In another embodiment of the invention, as seen in FIG. 2, the low voltage vacuum switch 30 has essentially the same structural elements as the embodiment of FIG. 1 and comprises an annular insulator body portion 32, pair of cylindrical contacts 34*a*, 34*b*, and a pair of annular flexible diaphragm members 36*a*, 36*b*. In this embodiment, a generally annular arcing shield 38 is a generally L-shaped member wherein a radially directed portion 40 extends from and is connected to one of the cylindrical contacts 34*a* proximate the contact end. The radially extending portion 40 of the shield 38 is such as to extend some distance between the contacts and the insulator body, and then has an annular shield portion 42 which is disposed between the insulator body 32 and the contact ends. The generally annular shield 38 is connected to that cylindrical contact which is connected to the more positive potential side of the operating circuit to which the switch is connected i.e., the anode portion of the electrolytic cell. The annular shield 38 thus protects and shields the flexible annular diaphragm 36*a* associated with the conductive contact to which it is mounted or connected and prevents the arc from alighting upon this thin annular flexible diaphragm. The annular shield 38 also serves to prevent deposition of arc material upon the insulator body as does the example of embodiment of FIG. 1 to again prevent deposition of the thin conductive film upon the insulator body which might thereby interfere with high voltage testing of the vacuum switch.

The annular arcing shield members 20 and 38 described in the embodiment of FIGS. 1 and 2, are preferably formed of a highly conductive heat dissipative material such as copper which has a thickness which is considerably more than the thickness of the annular flexible diaphragm portions of the switch. By way of example, the annular shield is typically formed of copper, which is about 1.5 millimeters thick. The spacing of the annular shield between the contacts and the annular insulator body portion is not critical but is preferably disposed closely proximate to the insulator body wall portion.

Figure 3:
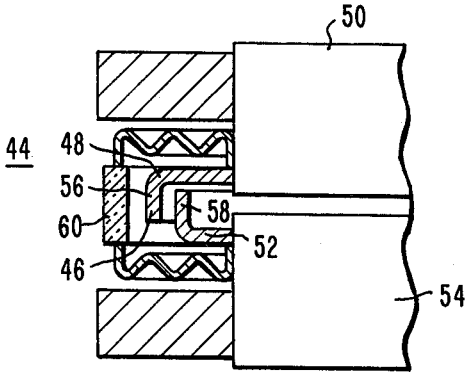
FIG. 3 is a partial elevational view in section of another embodiment low voltage switch of the present invention.

In yet another embodiment, seen in FIG. 3, the low voltage switch 44 has a two part arcing shield 46. The two part arcing shield 46 comprises a first annular L-shaped member 48 extending radially from one of the cylindrical switch contacts 50 and a second annular L-shaped member 52 extending radially from the other cylindrical switch contact 54. The members 48 and 52 have respective annular portions 56 and 58 which are annularly disposed in overlapping but spaced apart relationship between the switch contacts and the switch insulating body portion 60. The annular portions 56 and 58 must be sufficiently spaced apart to prevent arcing therebetween.

Figure 4:
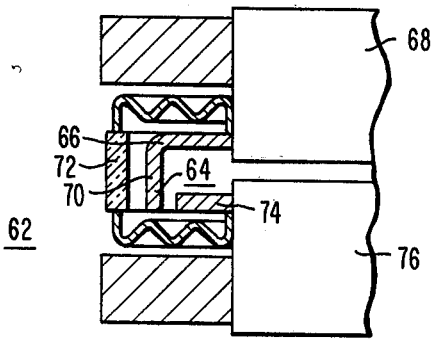
FIG. 4 is a partial elevational view in section of yet another embodiment.

In still another embodiment, seen in FIG. 4, the low voltage switch 62 has a two part arcing shield 64. The arcing shield 64 includes an annular L-shaped member 66 extending radially from one of the cylindrical contacts 68. The annular L-shaped member 66 includes an annular portion 70 which is disposed between the switch contacts and the insulating body portion 72 of the switch. The arcing shield 64 also includes an annular disk-like member 74 extending from the other cylindrical contact 76 of the switch. The two arcing shield members 66 and 74 are spaced apart to prevent arcing therebetween. This two part arcing shield prevents deposition of contact material on the insulating body portion of the switch as well as on substantial portions of the diaphragm seals.

In commercial usage, the vacuum switches are typically used in plural switch modules in which the switches are electrically in parallel. These plural switch modules are thus operable for high continuous D.C. current operation. It is also possible to further increase the current ratings for a single switch or the plural switch modules by water cooling the switch. This can be easily done by cooling the switch end plates.

The typical vacuum switch has cylindrical conductive contacts which are about 2.375 inch in diameter. The contact end surfaces which are the arcing surfaces when the switch is opened by separating the contacts are typically separated by about 3 mm. or ⅛ inch in the full open position.

The switch is a normally closed switch, with the force of atmospheric pressure sufficient to bias the contacts closed. The operating mechanism pulls the contacts apart to the open switch position.

The low voltage vacuum switch of the present invention is specifically designed for use with electrolytic cells, and for electrical shunting of such cells to permit isolation of the cell or cells from the total system for maintenance or replacement. Most such electrolytic cells, such as mercury cells for chlorine production operate at a D.C. voltage of about 4 volts. Other electrolytic cells used in metal refining operate at under 20 volts.

The vacuum switch of the present invention is designed to interrupt the very high D.C. current which flows through the closed contacts of the switch upon switch opening. The switch takes advantage of the fact that an arc cannot be maintained in a vacuum between the separated contacts below a contact potential difference of about 18 volts for copper, copper-bismuth or most generally used contacts. For cell systems which operate at higher D.C. voltage, or those which are subject to transients above about 18 volts, several vacuum switches of the present invention can be connected in series between the cell terminals to ensure that interruption is still possible and reliable.

The vacuum switch of the present invention has been designed for very high continuous D.C. current conduction through the closed contacts. The switch recommended current rating is based on maximum permissible operating temperature for the switch, and particularly for the external switch interface and connection with the bus bars or cell electrical terminals. The switch contacts are capable of very high current conduction, but the thermal limit has to do with the avoidance of oxidation of the interface of the switch external conductors to the bus bars or cell terminals. For a typical vacuum switch of the present invention with a 2.375 inch diameter contact, the continuous D.C. current rating is 6000 amperes at up to about 10 volts D.C., so that the continuous D.C. current per square inch of contact area is about 1600 amperes. This rating is arrived at since it will ensure that the switch operating temperature will not exceed about 105° C.

The thermal limit for switch operation can be controlled or affected in several ways with much higher allowable continuous current ratings being possible. An obvious modification is cooling means such as radiator fins or water cooling lines attached either to the vacuum switch body or end plates, or even on the bus bar connection near the switch connection point. The contact resistance can be varied somewhat and reduced by maintaining a higher closing force on the closed switch contacts. The contacts are normally closed contacts with the force of atmospheric pressure forcing the contacts together. It is normal in a switch operating mechanism to provide additional closing pressure provided by spring means to increase the total closing force for the 2.375 inch diameter contacts of from about 200 pounds up to about 600 pounds.

A plurality of vacuum switches of the present invention are typically used in electrical parallel in operation to reduce the current load in an individual switch and provide additional safety margins. The vacuum switches of the present invention, while usable at lower D.C. current levels, as a practical matter is selected for use where the continuous D.C. operating current is at least several thousand amperes, and typically at least 3000 amperes.

What is claimed is:

1. A vacuum switch for direct current electrolytic cell shunting operation, which switch is operable with the contacts closed at a high amperage D.C. continuous current, and which will interrupt this continuous current when the contacts are opened at a D.C. voltage across the contacts which is below the voltage at which an arc can be sustained between the contacts within the vacuum switch, which switch comprises an annular insulating body portion, a pair of annular flexible corrugated envelope portions, and a pair of cylindrical conductive contact members aligned along the switch axis, with respective cylindrical conductive contact members sealed to the inwardly extending periphery of the respective annular flexible corrugated envelope portion, and the outwardly extending periphery of each annular flexible corrugated envelope portion being sealed to the annular insulating body portion, the improvement wherein a generally annular arcing shield is disposed within the vacuum switch spaced about the contact ends of the cylindrical conductive contact members between the contact ends and the annular insulating body portion, which generally annular arcing shield extends from and is supported by the annular insulating body portion.

2. The vacuum switch set forth in claim 1, wherein the high amperage D.C. current is greater than about 3000 amperes.

3. The vacuum switch set forth in claim 1, wherein the high amperage D.C. current is such that the vacuum switch continuous operating temperature does not exceed about 105° C.

4. The vacuum switch set forth in claim 1, wherein the operating D.C. voltage across the switch contacts which is below the voltage at which an arc can be maintained between the contacts is less than about 18 volts.

5. The vacuum switch set forth in claim 1, wherein the continuous D.C. current is about 1600 amperes per square inch of contact area.

6. The vacuum switch set forth in claim 1, wherein the generally annular arcing shield has a support portion which extends in a radial direction from the generally annular shield, which support portion is connected to and supported by the annular insulating body portion of the switch.

7. The vacuum switch set forth in claim 1, wherein the arcing shield is a conductive metal which exhibits good heat dissipation characteristic.

8. A vacuum switch for direct current electrolytic cell shunting operation, which switch is operable with the switch contacts closed at high amperage D.C. continuous current, and which switch will interrupt this continuous current when the contacts are opened at a D.C. voltage across the contacts which is below the voltage at which an arc can be sustained between the contacts within the vacuum switch, which switch comprises an annular insulating body portion, a pair of annular flexible corrugated envelope portions, and a pair of cylindrical conductive contact members aligned along the switch axis, with respective cylindrical conductive contact members sealed to the inwardly extending periphery of the respective annular flexible corrugated envelope portion, and the outwardly extending periphery of each annular flexible corrugated envelope portion is sealed to the annular insulating body portion, the improvement wherein a generally annular arcing shield is disposed within the vacuum switch, which annular arcing shield is supported by and extends from the side of at least one cylindrical conductive contact and is spaced about the contact ends so as to shield the annular insulating body portion and also the annular flexible corrugated envelope portion sealed to the conductive contact from which the shield extends.

9. The vacuum switch set forth in claim 8, wherein the switch contact to which the annular arcing shield is attached is connectable to the more positive D.C. potential terminal of the electrolytic cell.

10. The vacuum switch set forth in claim 8, wherein generally annular arcing shields extend from the sides of both cylindrical conductive contacts to spaced overlapping relationship about the contact ends.

11. The vacuum switch set forth in claim 10, wherein the annular arcing shields are generally L-shaped with a radially extending portion connected to and extending from the sides of the cylindrical conductive contacts and an annular portion, with the annular portions spaced apart in overlapping relationship between the insulating body portion of the switch and the contact members of the switch.

12. The vacuum switch set forth in claim 10, wherein one of the annular array shields is generally L-shaped with a radially extending portion connected to and extending from the side of the cylindrical conductive contacts and an annular portion, and the other annular arcing shield comprises a radially extending member connected to and extending from the side of the other cylindrical conductive contact.

* * * * *